US008220177B2

(12) United States Patent
Bryan

(10) Patent No.: US 8,220,177 B2
(45) Date of Patent: Jul. 17, 2012

(54) CENTRIFUGAL PELLET DRYER SCREEN WITH INTEGRAL EMBOSSED DEFLECTOR STRIPS

(75) Inventor: David E. Bryan, Buchanan, VA (US)

(73) Assignee: Gala Industries, Inc., Eagle Rock, VA (US)

( * ) Notice: Subject to any disclaimer, the term of this patent is extended or adjusted under 35 U.S.C. 154(b) by 1037 days.

(21) Appl. No.: 12/081,396

(22) Filed: Apr. 15, 2008

(65) Prior Publication Data

US 2008/0289208 A1 Nov. 27, 2008

Related U.S. Application Data

(60) Provisional application No. 60/924,627, filed on May 23, 2007.

(51) Int. Cl.
*F26B 17/24* (2006.01)

(52) U.S. Cl. ..... 34/59; 34/138; 34/182; 34/168; 210/374; 210/377; 166/302; 166/345

(58) Field of Classification Search ..... 34/58, 59, 34/80, 90, 138, 182, 168, 201, 68; 210/374, 210/377; 166/302, 345
See application file for complete search history.

(56) References Cited

U.S. PATENT DOCUMENTS

| | | | | |
|---|---|---|---|---|
| 2,745,193 | A * | 5/1956 | Ladd et al. | 34/102 |
| 4,810,270 | A * | 3/1989 | Terry et al. | 55/294 |
| 5,265,347 | A | 11/1993 | Woodson et al. | |
| 6,582,819 | B2 * | 6/2003 | McDaniel et al. | 428/402 |
| 6,632,527 | B1 * | 10/2003 | McDaniel et al. | 428/402 |
| 6,698,107 | B2 | 3/2004 | Song et al. | |
| 6,739,457 | B2 * | 5/2004 | Humphries et al. | 210/374 |
| 2008/0289208 | A1 * | 11/2008 | Bryan | 34/59 |

FOREIGN PATENT DOCUMENTS

| | | | |
|---|---|---|---|
| DE | 202007004462 | U1 * | 7/2008 |
| JP | 2003050087 | A * | 2/2003 |

* cited by examiner

*Primary Examiner* — Stephen M. Gravini
(74) *Attorney, Agent, or Firm* — Jacobson Holman PLLC

(57) ABSTRACT

An embossed screen having raised deflector elements on the internal surface is provided for a centrifugal pellet dryer. The deflector screen is formed as an integral structure, eliminating the need for separate deflector components secured by fastening elements along with the associated risks such as loosening or separation of the strip and contaminate build-up between the strip and the screen. The embossed deflector screen effectively deflects the pellets back toward the rotor where the pellets are reengaged with rotor energy, resulting in increased dryer efficiency and flow rate. The embossed deflector screen also enhances the overall structural strength of the screen, reduces manufacturing costs and prevents pellet entrapment that can lead to contamination in future runs.

22 Claims, 9 Drawing Sheets

CENTRIFUGAL PELLET DRYER SCREEN WITH INTEGRAL EMBOSSED DEFLECTOR STRIPS

This application is entitled to and hereby claims the priority of U.S. Provisional application Ser. No. 60/924,627 filed May 23, 2007.

BACKGROUND OF THE INVENTION

1. Field of the Invention

The present invention generally relates to a centrifugal pellet dryer of the type which utilizes a bladed lift rotor conveying moisture laden plastic pellets or other solid particles upwardly within a cylindrical screen. The centrifugal force imparted to the particles by rotation of the lift rotor causes the particles to engage the interior surface of the screen, and moisture on the particles is discharged through the screen in a manner well known in the art. More specifically, the present invention relates to a product flow modifying deflector associated with the internal surface of the cylindrical screen.

2. Description of the Related Art

Centrifugal pellet dryers are well known in the art for separating water or moisture from plastic pellets and other solid particles, such as a slurry of water and plastic pellets produced by underwater pelletizers. Centrifugal pellet dryers of the prior art include a vertically disposed outer housing, a cylindrical screen oriented in the housing and a driven bladed rotor positioned centrally inside the screen. The rotor moves water laden pellets or other solid particles upwardly within the screen with centrifugal forces imparted to the particles by radial air flow from the rotor (see FIG. 1) causing the particles to move radially outwardly into engagement with the screen for discharge of water through the screen. The dried particles are discharged from the upper end of the screen and housing, and water is discharged from the lower end of the housing.

Centrifugal pellet dryers of this type are disclosed in U.S. Pat. Nos. 7,171,762, 7,024,794, 6,807,748, and 6,237,244, commonly owned by the assignee of this application. In the operation of such dryers, the pellets or other particles being moved vertically and radially by the bladed rotor engage the cylindrical screen with substantial velocity and usually bounce off the screen back toward the rotor for imparting further vertical and centrifugal forces to the particles as they are moved upwardly inside the screen. This is depicted by the "good" flow characteristic illustrated in FIG. 2. As further shown in FIG. 3, the "best" flow of both product and air occurs when the radial air flow from the rotor does not just push the pellets but actually flows around them.

However, conventional centrifugal dryers used in the market today all have a common problem relating to the air flow created by the normal rotation of the rotor. The combination of rotor blade geometry and other physical factors creates an air flow that can greatly affect the flow of the product through the dryer as it bounces between the rotor and the screen.

Furthermore, with the advent of newer plastic materials which form softer pellets, or pellets with flat or lentoid geometries, and the making of very small pellets, or so-called micropellets, using underwater pelletizers, difficulties have been encountered in conveying and subsequently drying such pellets in known centrifugal dryers. In addition, known centrifugal dryers have encountered difficulty in conveying and subsequently drying ground flake plastic materials which are formed from recycled soda bottles, milk containers and the like, as well as certain other plastic particles such as ground battery casings.

More specifically, and as depicted by the "poor" flow characteristics in FIG. 2, softer and smaller pellets, pellets with flat or lentoid geometries, and plastic flakes, as well as certain other plastic and similar particles, tend to collect and circulate in the clearance band "X" (see FIG. 2) between the outer edges of the rotor blades and the inner surface of the screen. Rather than bouncing around in the manner of harder and larger pellets or particles, these particles become trapped against the screen by the air flow. This undesirable circular flow and resultant entrapment of the softer and smaller pellets, pellets with flat or lentoid geometries, and plastic flakes and particles along the inner surface of the screen is sometimes referred to as "banding". This banding reduces product flow through the rotor area of the dryer and increases power requirements for maintaining rotational speed of the rotor. Further, it has been found that banding also reduces the efficiency of moisture separation from the solid particles, can cause high amperage requirements within the dryer, and reduces overall efficiency of the centrifugal dryer. These problems often result in fines and fiber-like "hair" production (often referred to as angel hair in the industry).

The problem of banding is particularly evident with pellets having a flat or lentoid geometry as the relatively large planar surface area of this shape most naturally causes the pellets to adhere to the inner surface of the screen and, because of the associated low profile of such pellets, makes them difficult to dislodge. As illustrated by the "worst" flow in FIG. 3, the larger the product's surface area in one dimension, or the more flake-like or lentoid the product, the greater the opportunity for the outward air flow of the rotor to trap the product against the screen. This phenomenon greatly reduces the necessary bounce required to reengage the product with the outward and upward action of the dryer rotor.

One solution for overcoming this problem of banding is set forth in U.S. Pat. No. 6,739,457 ("the '457 patent"), which is commonly owned by the assignee of this invention. The disclosure of the '457 patent is hereby expressly incorporated herein by reference as if fully set forth in its entirety.

In the '457 patent, deflector strips are fastened to the inside of the dryer screen using multiple fasteners fitted within countersunk holes machined within the strips. This method of fastening results in the deflector strips being relatively expensive to manufacture and also necessitates that the screen also be provided with dedicated holes which can create undesirable stress concentrations within the screen. In addition, should the fasteners become loosened, either through vibration, aging or other cause, there is the risk that the deflector strips could extend into the moving rotor with resulting damage. Further, any spacing between the deflector strip and the screen may collect portions of the pellets or other foreign matter, particularly with pellets having a flat or lentoid geometry, thus leading to possible contamination in future product runs.

SUMMARY OF THE INVENTION

The present invention is used with a centrifugal pellet dryer of the vertical type having a vertical cylindrical screen associated with a vertical housing and a bladed rotor oriented inside the cylindrical screen for conveying a slurry of water and polymer resin particles upwardly in the dryer. Centrifugal forces imparted to the solid particles by the rotor cause the particles to impact the screen to discharge water outwardly through the screen, while dried particles are discharged from an upper end of the dryer and water is discharged from the lower end of the housing in a manner well known in this art. Cylindrical screens for centrifugal pellet dryers are typically made from several screen sections which are vertically aligned and interconnected together.

In order to overcome the problems of such centrifugal dryers when separating water from soft and/or small pellets or plastic flakes, and certain other plastic particles with difficult to convey geometries such as lentoid-shaped pellets, as well as the problems associated with the fastened-on deflector strips of the '457 patent, the inside of the cylindrical screen is provided with one or more embossed regions, each of which effectively forms an integral deflector protruding from the inside surface of the screen. As with the fastened-on deflector strips of the '457 patent, the embossed screen of the present invention disrupts the circular flow of the particles to improve particle flow through the rotor area of the dryer by aiding in the rotor's vertical lift of the particles and by eliminating particle banding. Unlike the prior art, however, the embossed deflector screen eliminates the risks of contamination and of a loose deflector strip extending into the moving rotor, while also reducing manufacturing costs. In addition, because the embossed regions are preferably integrated into a non-perforated area of the screen, the embossed regions actually strengthen the overall screen structure.

It is therefore an object of the present invention to provide a deflector element on the interior of a cylindrical screen of a centrifugal pellet dryer in the form of one or more elongated deflector strips which are formed by embossing a perforated or non-perforated area of the screen.

Another object of the present invention is to form one or more deflector elements or regions through embossing at locations that are circumferentially spaced around the interior surface of the screen with the number of deflector elements or regions being varied depending upon the diameter of the screen, with there preferably being one to four deflector elements or regions in most cases.

A further object of the present invention is to integrally form one or more deflector elements in the form of vertical or acutely angled elongated deflector strips on the interior surface of the cylindrical screen in a cylindrical pellet dryer in accordance with the preceding objects such that the embossed strips enhance the overall strength of the screen.

A still further of the present invention is to form one or more embossed deflector elements in the form of elongated strips on the dryer screen having smoothly ramped edges formed integrally with the screen which prevent pellets from being lodged against the strips and ensure redirection of the pellets back into the rotor where the pellets are reengaged with rotor energy for reenergized upward movement.

Yet another object of the present invention is an embossed deflector screen that provides a retrofitable solution to the known problems of flat and lentoid-shaped products becoming trapped against the screen in a centrifugal pellet dryer.

A further object of the present invention is an embossed deflector screen that allows a centrifugal pellet dryer of a given size to run higher product flow rates which expands the scope of production achievable without obtaining a larger dryer.

A still further object of the present invention is to provide a deflector element or region for the cylindrical screen of centrifugal pellet dryers in accordance with the preceding objects and which will conform to conventional forms of manufacture, be of simple construction and easy to use so as to provide a deflector screen that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
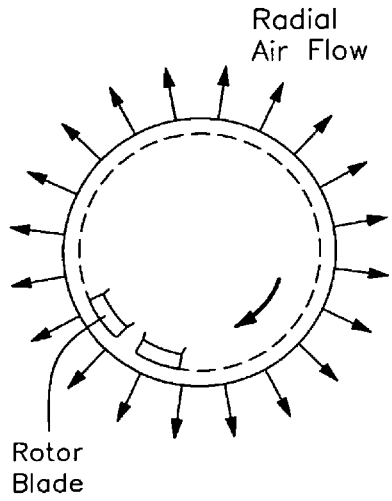
FIG. 1 (PRIOR ART)
FIG. 1 generally depicts the radial air flow of a conventional rotor in a centrifugal pellet dryer.
Figure 2:
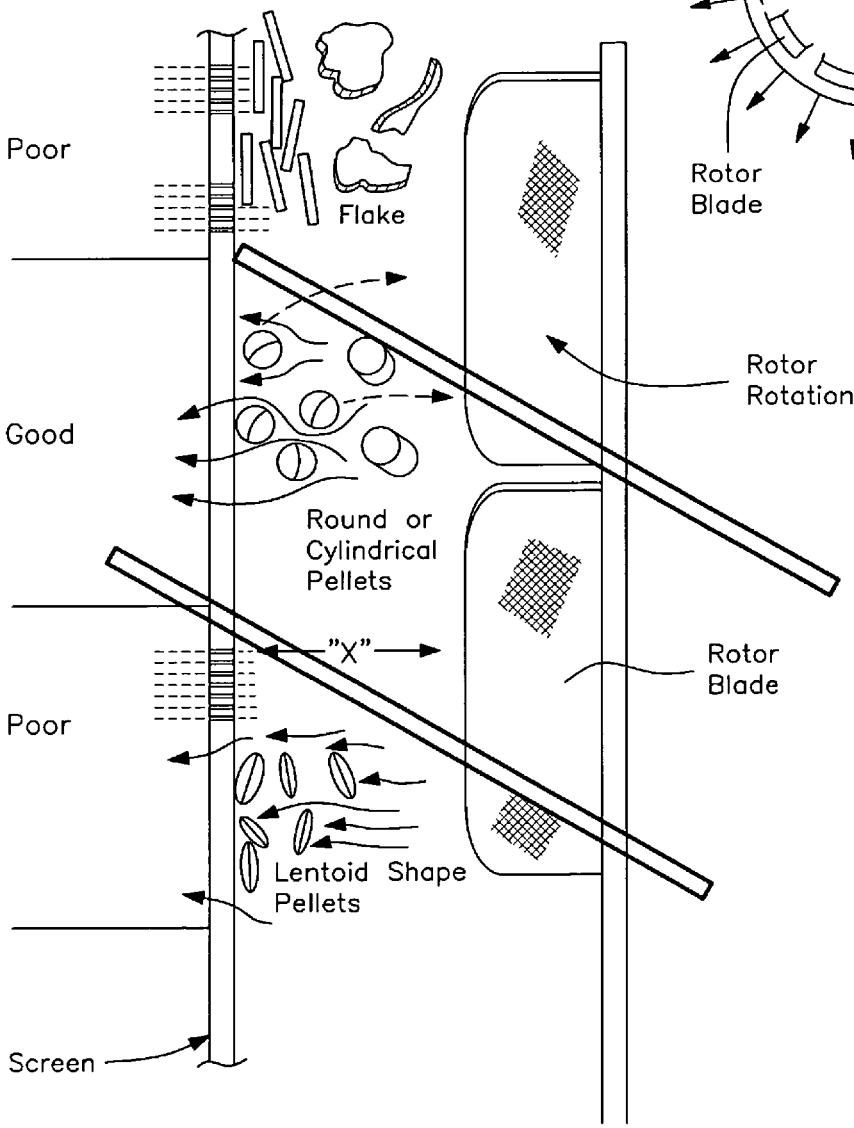
FIG. 2 (PRIOR ART)
FIG. 2 illustrates the effects of air flow from the rotor of FIG. 1 and the resulting flow characteristics of various different shaped pellets.
Figure 3:
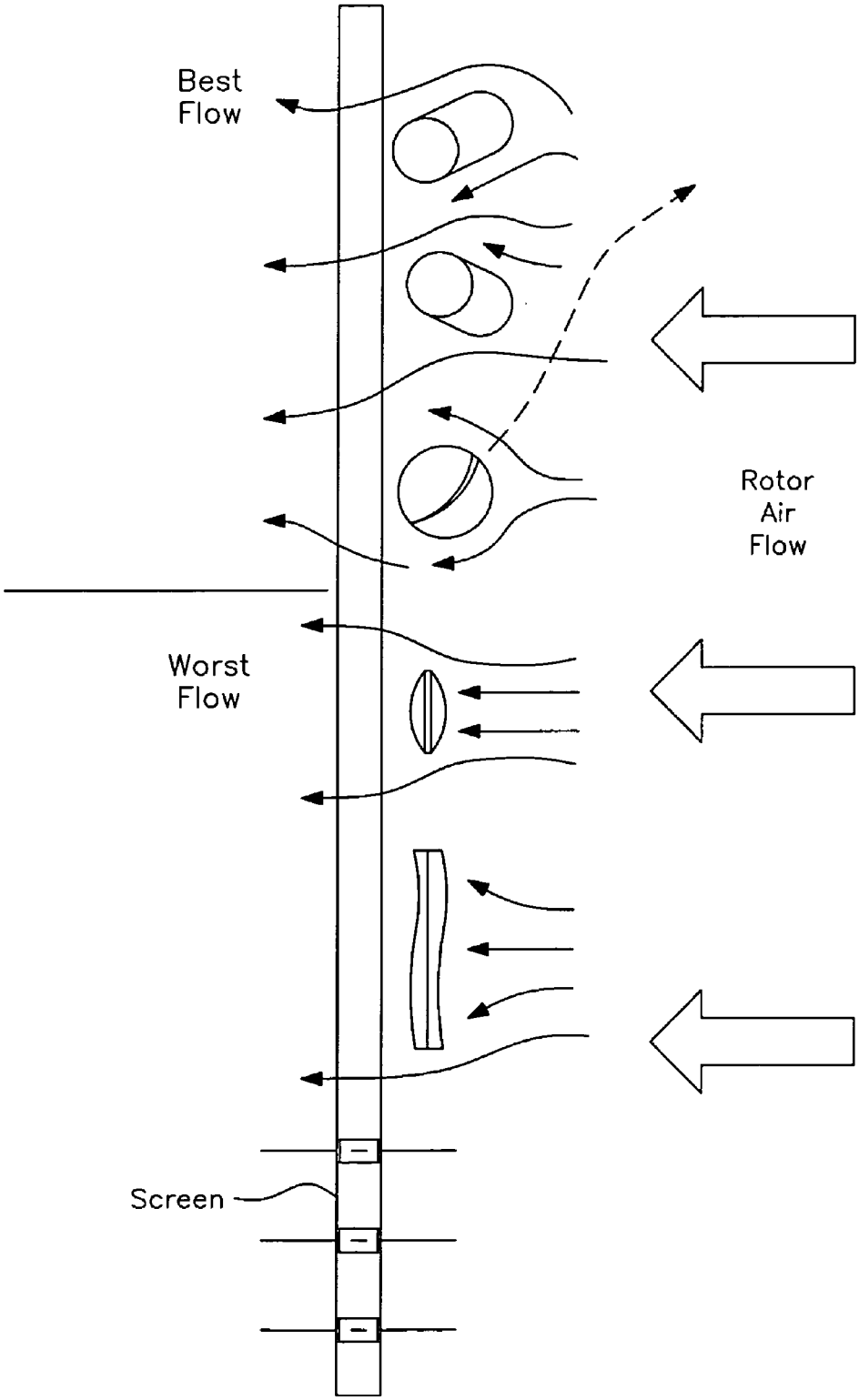
FIG. 3 (PRIOR ART)
FIG. 3 is a further illustration of best and worst air and pellet flow characteristics associated with the various shaped pellets of FIG. 2.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Although only certain embodiments of the invention are explained in detail, it is to be understood that the invention is not limited in its scope to the details of construction and arrangement of components set forth in the following description or illustrated in the drawings. The invention is capable of other embodiments and of being practiced or carried out in various ways. Also, in describing the various embodiments, specific terminology will be resorted to for the sake of clarity. It is to be understood that each specific term includes all technical equivalents which operate in a similar manner to accomplish a similar purpose.

Figure 4:
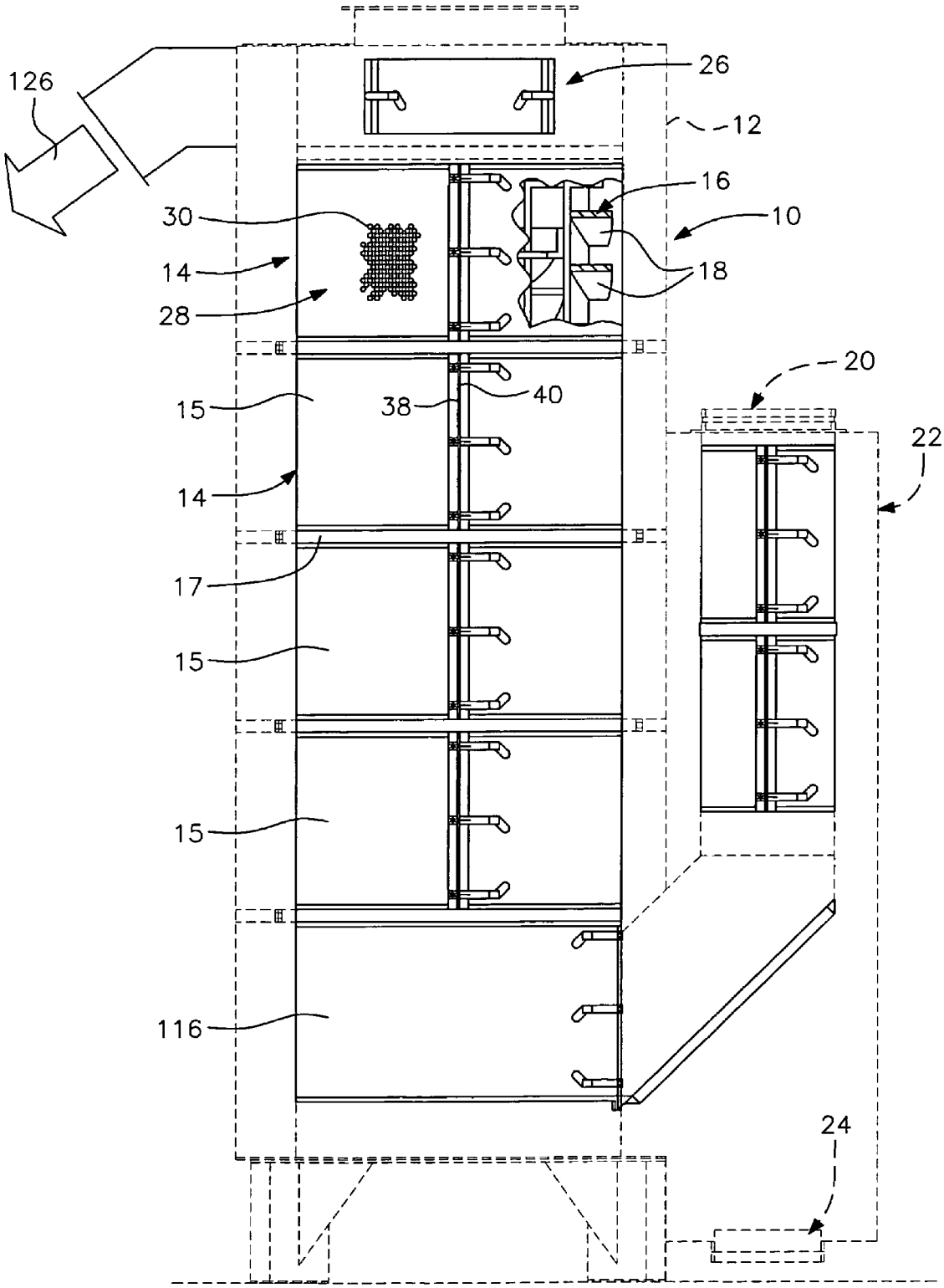
FIG. 4 (PRIOR ART)
FIG. 4 is a schematic elevational view of a prior art centrifugal pellet dryer illustrating a sectional cylindrical screen and bladed lift rotor assembly associated with a dryer housing.

Referring to FIG. 4, a conventional centrifugal pellet dryer of the vertical type is generally designated by reference numeral 10 and includes a dryer housing 12 having a sectional screen 14 mounted vertically therein. The sectional screen 14 is shown having four approximately equal screen sections 15 aligned vertically and interconnected at 17. The screen 14 encloses and is concentric to a bladed rotor, generally designated by reference numeral 16, which includes inclined blades 18. The blades 18 include outer edges adjacent the interior surface of the screen sections 15 supported in a manner well known in the art.

The dryer 10 includes an inlet 20 for receiving a slurry of water and pellets from an underwater pelletizer, or other type water slurry containing solid particles, such as plastic flakes, from recycled soda bottles, milk containers, etc., or other solid plastic particles such as ground battery casings. The inlet 20 typically, although not in all centrifugal dryers, discharges the slurry into a dewaterer 22 for initial separation of water from the pellets or other solid particles for discharge of water through an outlet 24 and discharge of moisture laden particles into the bottom section of the sectional screen 14. The solid particles move upwardly through the screen sections 15 by the action of the rotor 16 to an outlet 26 at the upper end of upper screen section 15 in the direction indicated by the arrow 126. The rotor imparts lift and centrifugal forces to the particles to impact the particles against the screen for separating water from the particles with the separated water passing through the screen into the housing and out through outlet 24 in a manner well known in the art as exemplified by the previously mentioned prior patents.

Figure 5:
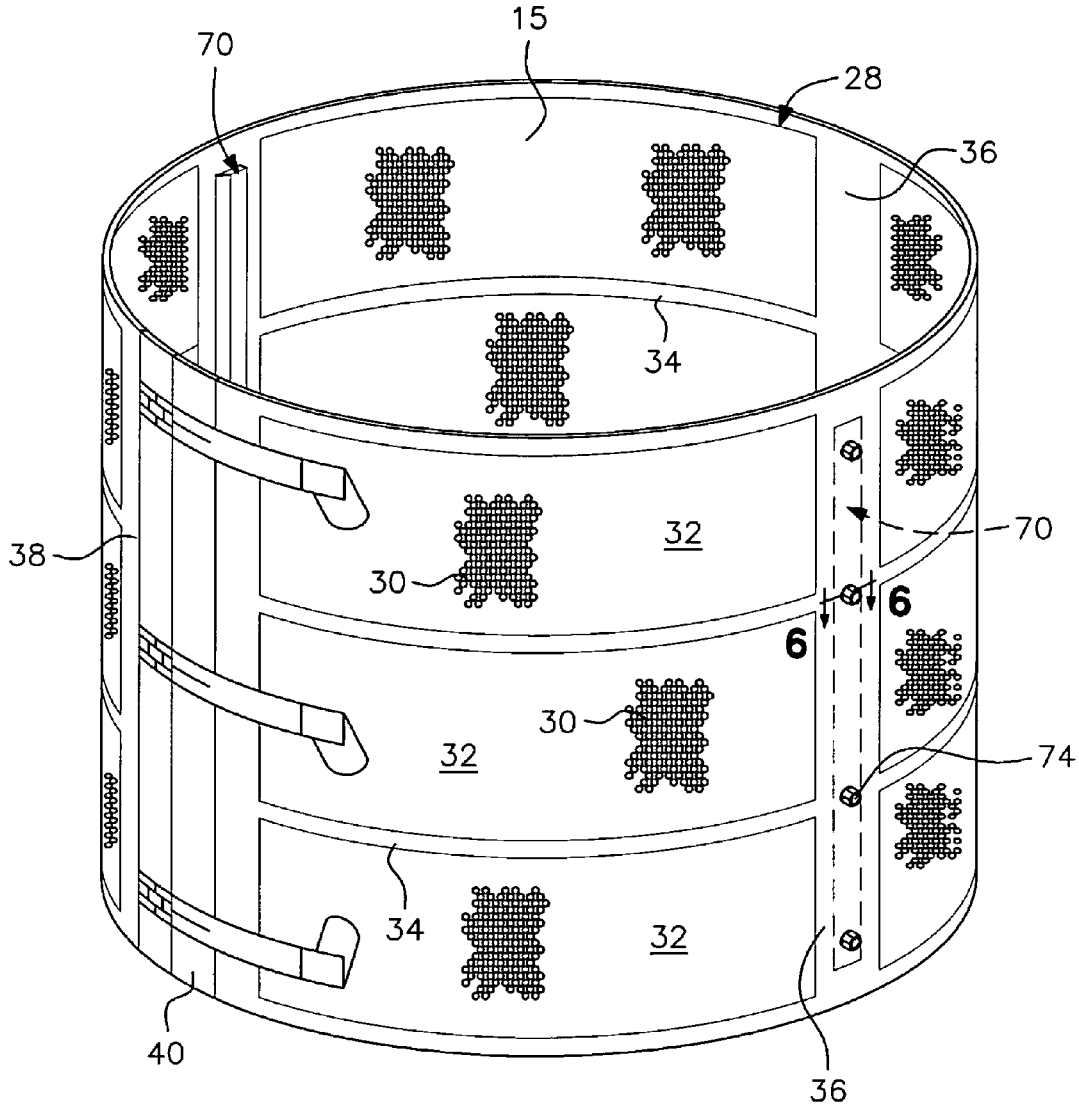
FIG. 5 (PRIOR ART)
FIG. 5 is a perspective view of one of the dryer sections of FIG. 4, having two deflector strips mounted on the interior surface with fastening elements in accordance with the prior art.

Each of the screen sections 15 includes a plate 28, typically of stainless steel with 20 or 18 gauge thickness and 0.075 inch diameter holes 30 punched therethrough from the surface facing inwardly of screen section 15. Other hole shapes and diameters such as 0.038 inch, 0.085 inch, 0.0625 inch are also commonly used. As shown in FIG. 5, the holes 30 have staggered centers and are oriented in discrete areas 32 thereby defining intersecting solid sections 34 and 36. Each of the screen sections 15 is initially formed as a flat plate 28, which is retained in a cylindrical configuration by connecting outwardly extending vertical side edge flanges 38 and 40 on the respective vertical solid edges the screen section. Further description of the connecting mechanisms is set forth in the '457 patent.

Figure 6:
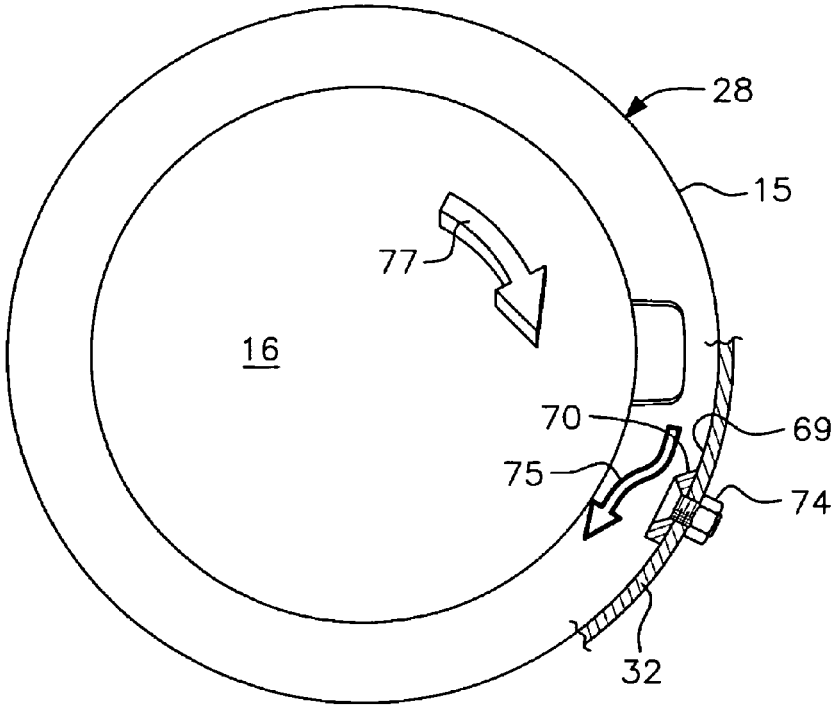
FIG. 6 (PRIOR ART)
FIG. 6 is a schematic partial sectional view of the screen section and one of the conventional deflector strip shown in FIG. 5.

The two deflector strips shown in FIG. 5, and generally designated by reference numeral 70, are mounted on the inside surface of the cylindrical screen section 15. As can be seen in FIGS. 5 and 6, the deflector strips 70 are attached by bolts which protrude through matching holes in the cylindrical screen section 15 on which appropriate locking nuts 74 can be installed to affix each deflector strip 70 in place on the inside of the screen section. Once in place, the deflector strip 70 redirects pellet flow as indicated by the solid arrowed line 75 in FIG. 6, when the rotor 16 turns as indicated by the inner arrow 77.

Attachment of the deflector strips as shown in FIGS. 5 and 6 is subject to loosening of the fastening elements 74 and possible separation of the deflector strip 70 as previously described. In addition, because the deflector strips are a separate component, the interface between the strips and the screen also provides an area in which pellets, particularly those having a low profile and a flat or lentoid shape, may become lodged or trapped. As with bolted on deflector strips 70, the area 69 of the screen just in front of the bevel (see FIG. 6), as viewed with respect to the direction of rotor rotation, is subject to greater wear and resulting erosion.

Figure 7:
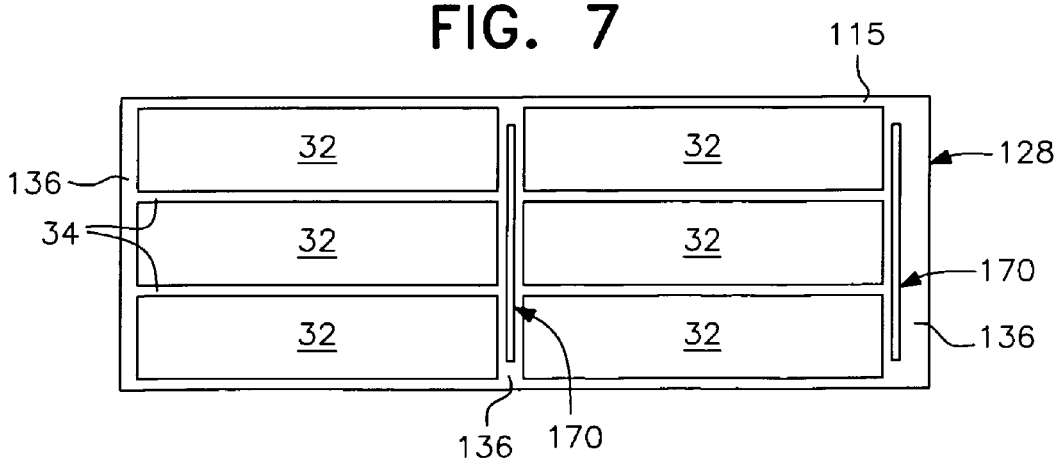
FIG. 7 is a plan view of a screen section with two embossed deflector elements each in the form of an elongated vertical strip in accordance with the present invention.
Figure 8:
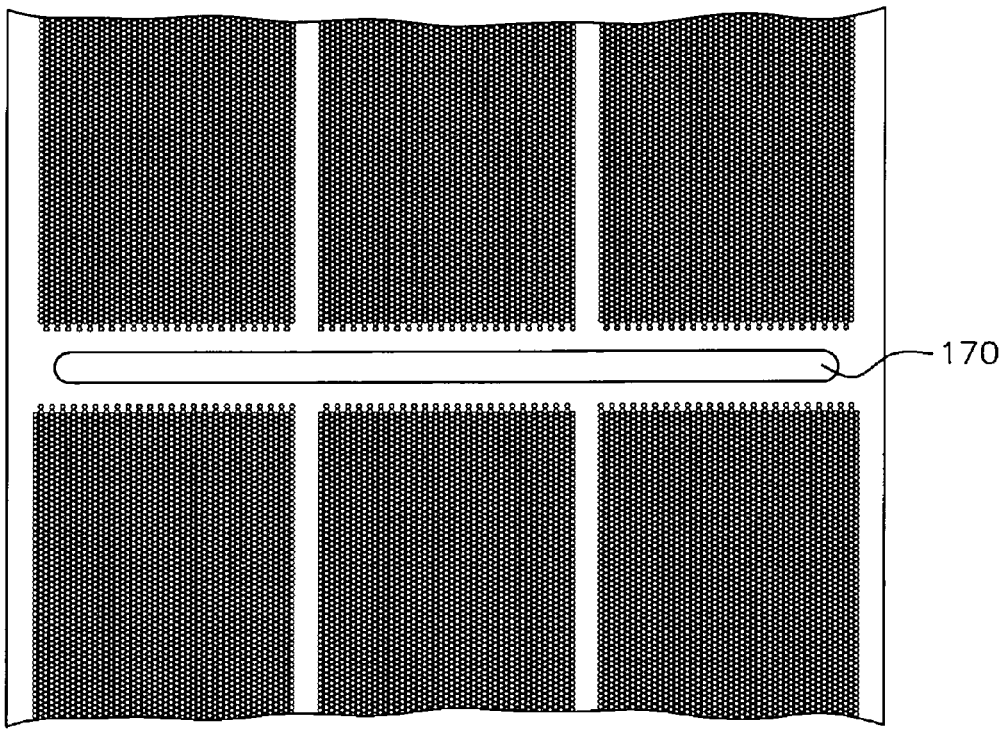
FIG. 8 is a photograph of the center embossed deflector strip of FIG. 7.
Figure 9:
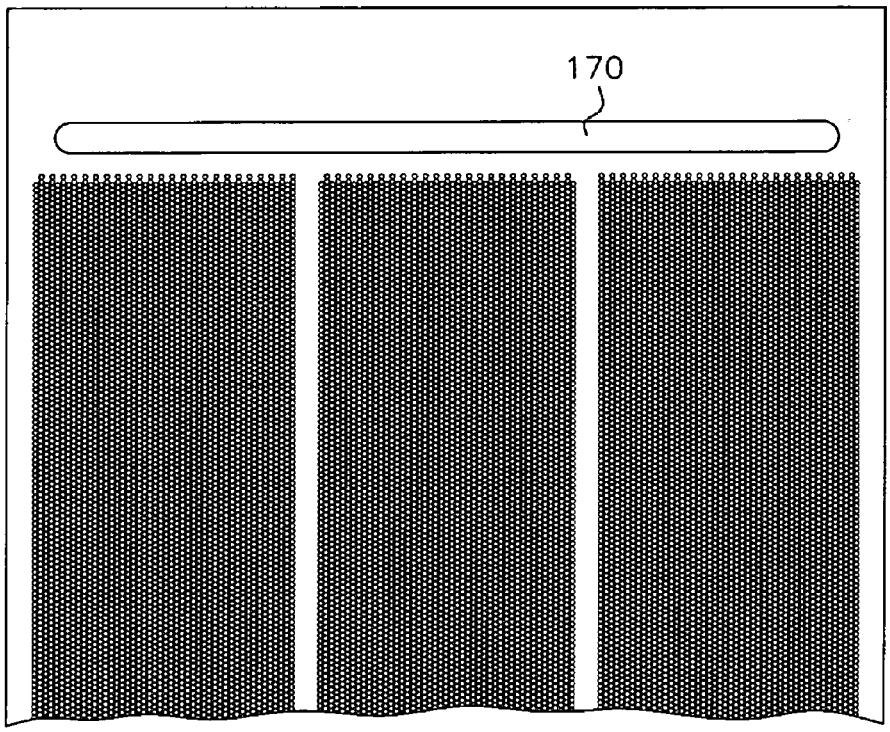
FIG. 9 is a photograph of the end embossed deflector strip on FIG. 7.

In view of the foregoing, a screen section 115 in accordance with the present invention, having an embossed region in the form of a vertical or substantially vertical embossed deflector strip generally designated by the reference numeral 170 is shown in FIG. 7. The embossed deflector strip 170 is typically formed in a non-perforated solid section 136 of the screen that runs between the discrete areas 32 having holes therein of the plate, generally designated by the reference numeral 128. The screen section 115 may be provided with only a single embossed deflector or multiple deflectors such as, for example, the two embossed deflectors 170 shown in the center and end portions of the screen section 115 of FIG. 7. These center and end portion embossed deflectors are depicted photographically in FIGS. 8 and 9, respectively.

Alternatively, the embossed deflector strip could be formed in the perforated areas 32, although this is not preferred as structural strength may be impacted. As a further alternative, if produced at an acutely angled orientation relative to the vertical, the embossed deflector strips may be made to extend across or into portions of both the perforated and non-perforated sections of the screen.

Figure 10:
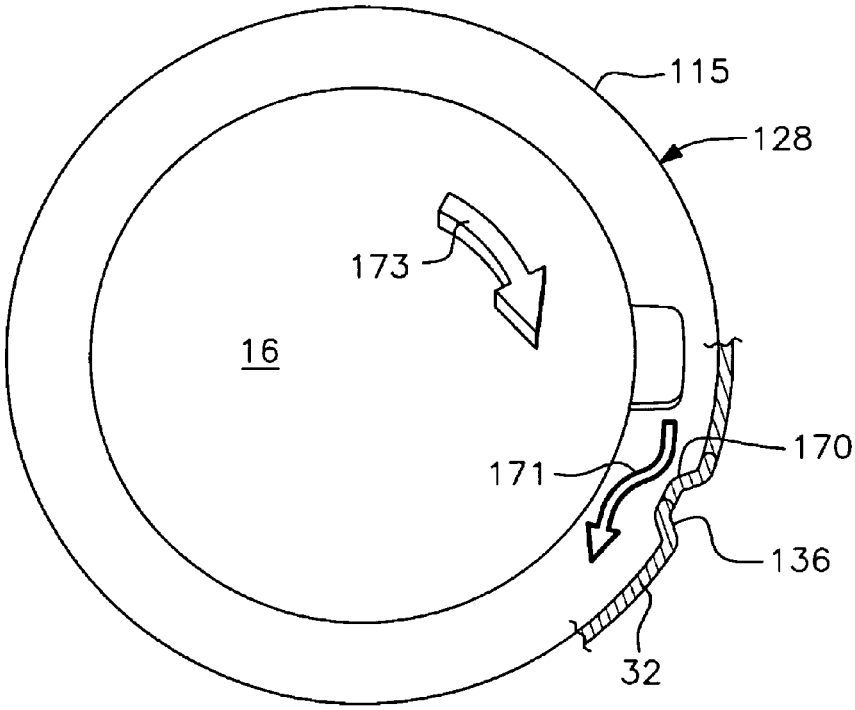
FIG. 10 is a schematic partial sectional view of the screen section and one of the embossed deflector strips shown in FIG. 7.

As illustrated in FIG. 10, and like the conventional deflector strip in FIG. 6, the embossed deflector strip 170 effectively redirects pellet flow as indicated by the solid arrow 171 when the rotor 16 turns in the direction indicated by the inner arrow 173. Unlike the deflector strip of the '457 patent, however, the embossed deflector strip eliminates the risk of loosened fasteners as well as loose and/or detached deflector strips.

Forming the deflector regions by embossing, whether the regions are embodied in strips or other configurations, also creates a smoothly ramped edge that offers no opportunity for pellet entrapment between the strip and the screen, thus eliminating the associated risk of contamination in future runs. Particularly when used with flat or lentoid shaped pellets, the smooth continuous embossed edge is more effective at ensuring consistent pellet redirection off the screen and into the rotor than earlier designs. Once redirected, the rotor can then impart continual energy to the pellets which facilitates their upward movement and overall efficiency of the dryer by decreasing the tendency for the rotor to act as an auger when pellets are the type that resist current methods of centrifugal drying. In addition, the embossed deflector strips actually reduce screen wear in the area of the screen just in front of the embossed strip. By providing increased wear resistance in the area of the screen where the pellets are deflected, an area that had previously been subject to wear and resulting screen erosion, the embossed deflector strips increase the life of the screen.

Figure 11:
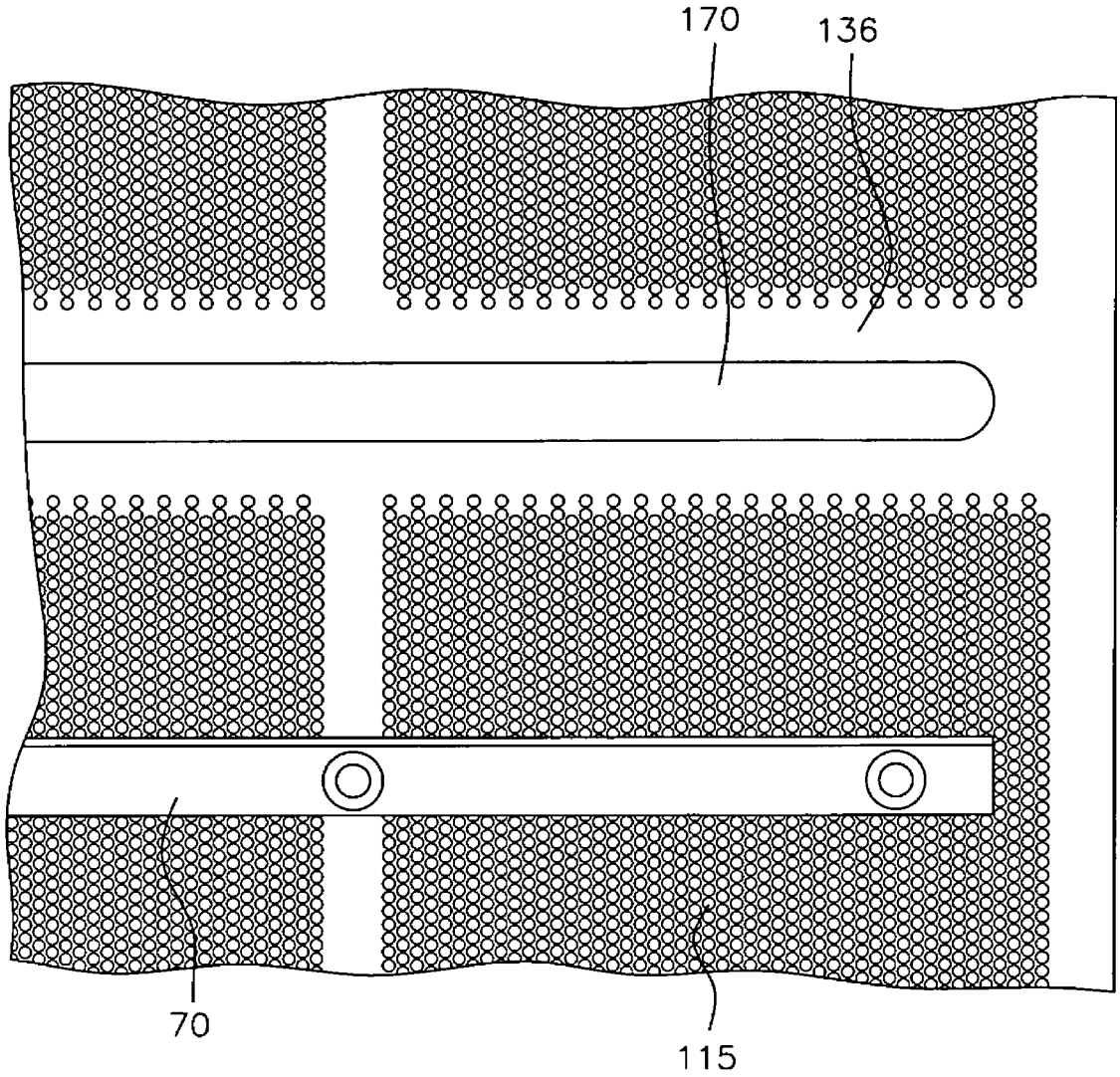
FIG. 11 is an enlarged photograph of a portion of an embossed deflector strip formed in a non-perforated area of a screen section according to the present invention, adjacent to which a portion of a deflector strip according to the '457 patent is shown placed onto the screen section for comparison.

Further, as can be seen by the photograph of FIG. 11, the embossed deflector strip 170 strengthens the solid section 136 of the screen section 115 against bending and flexing. The deflector strip 70 of the '457 patent, by contrast, with its bolted fasteners which necessitate that dedicated holes be located in the perforated or non-perforated areas of the screen, can create stress concentrations within the screen such that the addition of the strip 70 may not offer additional screen structure integrity.

The number, angle and spatial relation of the embossed deflector regions may vary depending on the diameter of the screen sections 115 and the particular application of the dryer. Usually one to four embossed deflector strips 170 are adequate in most screen sections up to about 64 inches in diameter; greater numbers of deflector strips may, of course, be included as desired. Also in dryers having multiple screen sections 115, the lowest screen section 116 (see FIG. 4), where the water and solid particle slurry enter the screen, may be constructed without deflector strips as the pellets have a lot of energy upon entry from the feed chute. In the upper sections having the deflector strips, the strips are preferably aligned vertically, although such alignment is not always necessary.

The embossed deflector strips can be implemented with conventional unitary screens of screen sections, as of stainless steel with 20 or 18 gauge thickness and holes having commonly used diameters of 0.038 inch, 0.075, 0.085 inch, or 0.0625 inch. The screens or screen sections can also be made with lasered holes or by other methods of manufacture as would be understood by persons of ordinary skill in the art. Multi-layered screens such as those set forth in co-pending application, Ser. No. 11/017,216, which is commonly owned by the assignee of this application, can also be modified to include the embossed deflector strips in accordance with the present invention.

Figure 12:
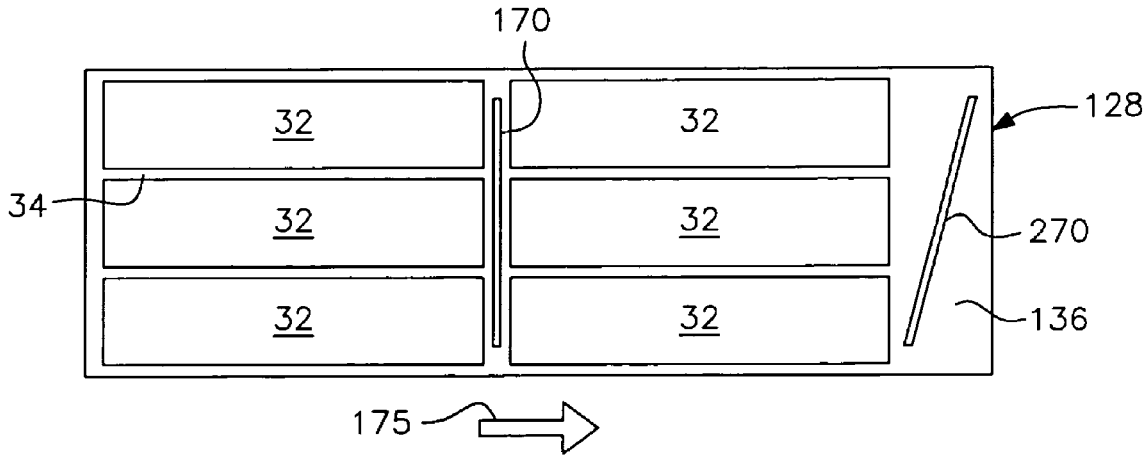
FIG. 12 is a plan view of a screen section with two embossed deflector elements in the form of vertical and angled deflector strips in accordance with the present invention.
Figure 13:
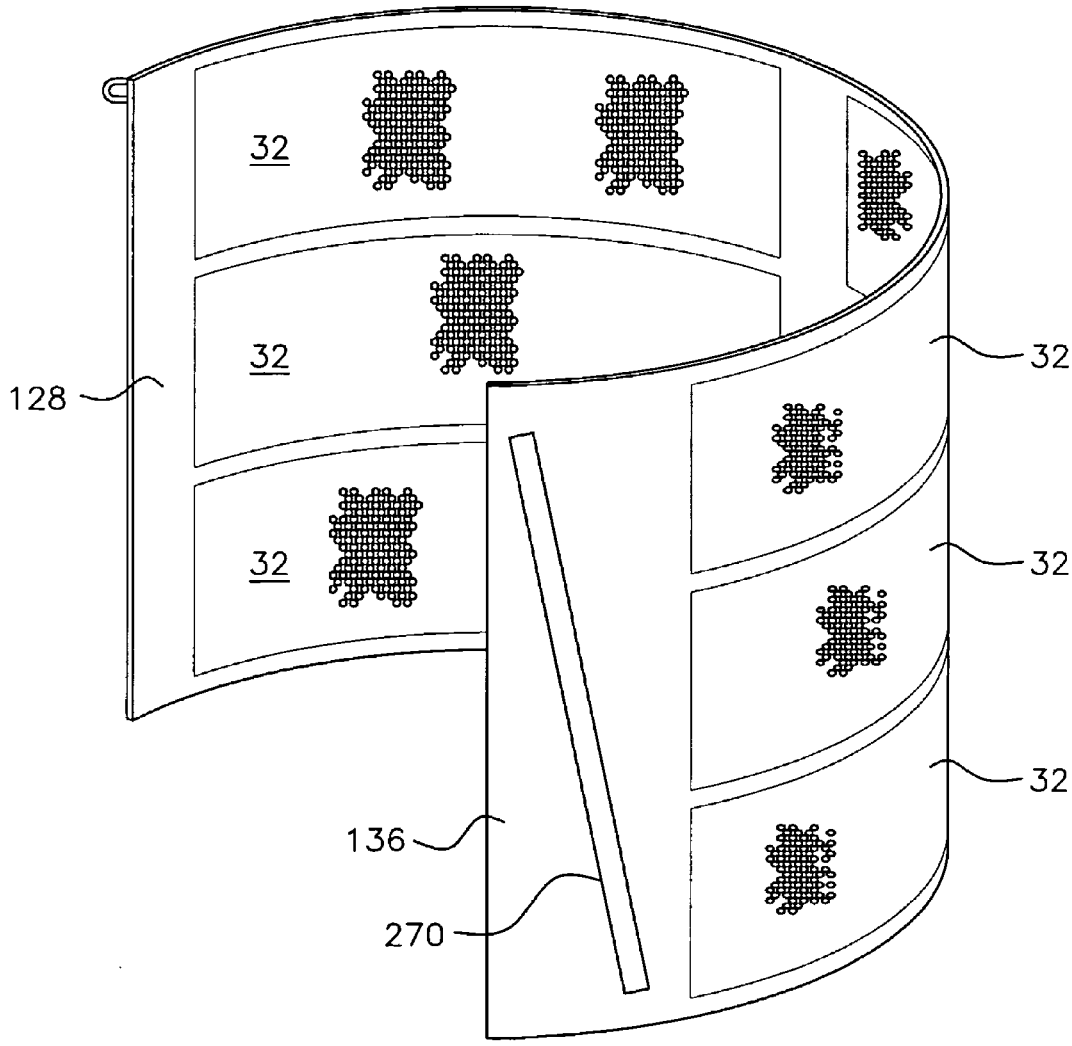
FIG. 13 is a perspective view of the screen section of FIG. 12.

While in a preferred embodiment the embossed deflector strips are vertical or substantially vertical, the embossed deflector strips may be formed at an acute angle relative to the vertical so as to lean away, moving from the bottom of the screen plate 128 to the top thereof, from the direction of the rotor. Such an angled embossed deflector strip 270, as illustrated in FIGS. 12 and 13, may be used to create a more upward trajectory in the movement of the pellets as they impact against and are redirected toward the rotor by the upwardly inclined edges of the embossed deflectors. Vertical and angled deflector strips may also be combined within the same screen as shown in FIG. 12 in which the arrow 175 indicates rotor direction.

The embossed deflector strips 170 of the present invention are typically U-shaped in cross section (see FIG. 10) and protrude inwardly, relative to the non-embossed inner surface of the screen section 115, by about 0.10 inches to about 0.25 inches, and most preferably about 0.14 inches, and have a width of about 0.25 inches to about 0.80 inches, and most preferably about 0.62 inches. Other dimensions can, of course, be provided and, unlike the mounted deflector strips, do not impact the overall weight of the screen section. For example, in the arrangement of FIGS. 4-6, adding a deflector strip having a larger thickness or larger width will add to the weight of the screen section and place greater demands upon the fastening elements in larger dryer applications. With the embossed deflector regions of the present invention, however, the dimensions of the embossed strip simply alter the percentage of the solid section 136 that projects inwardly but do not change the overall weight of the screen section 115.

The length of the embossed deflector strips 170 depends upon the height of the cylindrical screen section 115, or cylindrical screen if one piece, and are preferably of a length so as to leave a space of about one inch from the top and bottom ends of the deflector strip to the upper and lower edges of the screen section (or screen) so as to not interfere with sealing, although this spacing can be varied as desired.

While the embossed deflector strips 170 are preferably continuous raised strips, they could be discontinuous and of smaller length so as to facilitate the required wrapping of the screen around the support rings to obtain the cylindrical configuration. Continuous raised strips are preferred because they tend to provide a continuous length of deflection and to offer a great degree of added stiffening to the cylindrical screen or screen section. As such, it is possible that the embossed strips may allow for a thinner screen plate 128.

If the embossed strips 170 are discontinuous, they might preferably be arranged in a vertical staggered array from adjacent the bottom edge of the screen plate 128 to adjacent the top edge of the screen plate 128. In such a manner, banding solid particles which miss one raised strip in a circumferential pass around the clearance band would encounter another raised strip in its path. This staggered arrangement could be similarly embodied with angled embossed deflector strips.

Figure 14A:
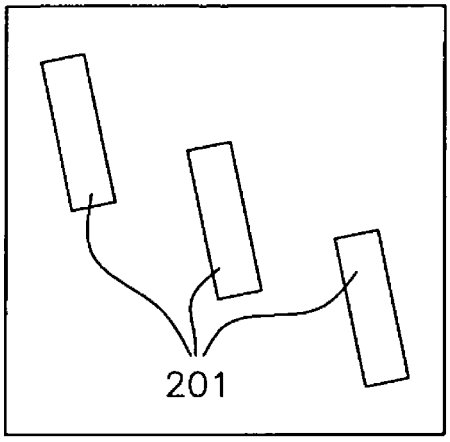
FIGS. 14A-14D are illustrations of alternative configurations for the embossed regions of the embossed deflector screen according to the present invention.
Figure 14B:
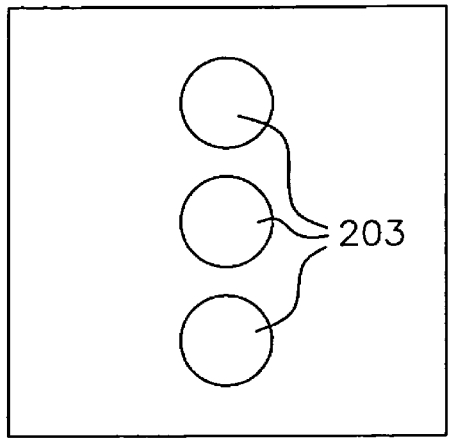
Figure 14C:
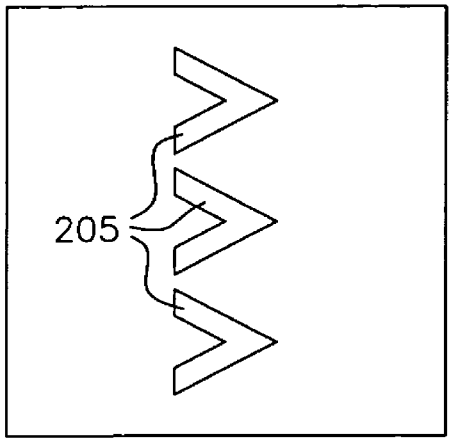
Figure 14D:
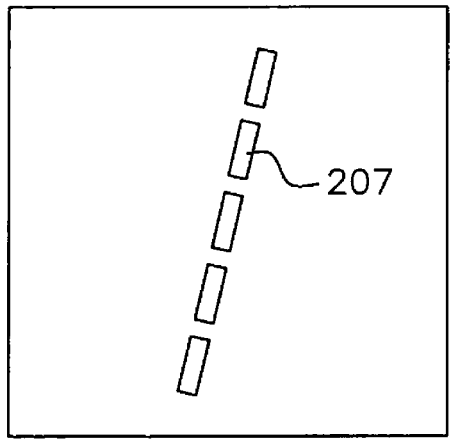

The embossed regions can also be produced in shapes other than elongated strips. Without being limited thereto, examples of alternate embossed region configurations are shown by the horizontally and vertically staggered rectangles 201 shown in FIG. 14A, the vertically spaced circles 203 shown in FIG. 14B, the vertically spaced arrowheads 205 shown in FIG. 14C and the vertically spaced rectangles 207 in sloped alignment shown in FIG. 14D.

Whatever the specific configuration of the embossed regions, the embossed deflector screen in accordance with the present invention increases the overall efficiency of the pellet dryer and results in considerable savings in terms of capital investment. More particularly, for a dryer of a given size, greater product flow rates can be achieved with the embossed deflector screen than with conventional dryer screens. As a result, a smaller dryer can be used to effectively meet production requirements that would otherwise have required the purchase of a larger dryer. By avoiding the need for this purchase, cost savings on the order of tens and even hundreds of thousands of dollars can be realized.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. The combination comprising a centrifugal pellet dryer and a substantially cylindrical screen in said centrifugal pellet dryer for separating water from pellets in said dryer, said screen having an inside surface with one or more raised regions, each raised region protruding inwardly to form a deflector that disrupts a circular flow of particles being dried to improve particle flow through a rotor area of the dryer, said deflector being integral with said screen such that said deflector is not a separate component from the screen and does not impact an overall weight of the screen.

2. The combination as set forth in claim 1, wherein each raised region of the screen forms a substantially vertical raised deflector strip.

3. The combination as set forth in claim 2, wherein said screen includes a plurality of raised regions formed as substantially vertical strips spaced from one another around the inside surface of the screen.

4. The combination as set forth in claim 3, wherein said strips formed on said screen are arranged in a staggered array from adjacent a bottom edge of the screen to adjacent a top edge of the screen.

5. The combination as set forth in claim 1, wherein said screen includes perforated and non-perforated areas, said raised regions being formed in said non-perforated areas.

6. The combination as set forth in claim 1, wherein said integral deflector of said screen has a smoothly continuous ramped edge with adjacent non-raised portions of said screen inner surface.

7. The combination as set forth in claim 1, wherein said screen deflector is embossed and protrudes inwardly, relative to non-embossed portions of said inner surface, about 0.10 inches to about 0.25 inches.

8. The combination as set forth in claim 7, wherein said screen deflector has a width of about 0.25 inches to about 0.80 inches.

9. The combination as set forth in claim 1, wherein said screen deflector is embossed and protrudes inwardly, relative to non-embossed portions of said inner surface, about 0.14 inches and have a width of about 0.62 inches.

10. The combination as set forth in claim 1, wherein said raised region of said screen forming a deflector extends substantially from a top of the screen to a bottom thereof.

11. A centrifugal pellet dryer comprising a dryer housing having a cylindrical screen mounted vertically therein, generally concentric with a bladed rotor, an inlet for receiving a slurry of water and solid particles from an underwater pelletizer into a bottom section of the screen, said solid particles being moved upwardly in a circular flow through the screen by the rotor to an outlet at an upper end of the screen, an inner surface of said screen having a raised region that protrudes inwardly to form a deflector that disrupts the circular flow of particles being dried to improve particle flow through the dryer, said deflector being integral with said screen such that said deflector is not a separate component from the screen and does not impact an overall weight of the screen.

12. The dryer as set forth in claim 11, wherein each raised region forms a substantially vertical raised deflector strip.

13. The dryer as set forth in claim 12, wherein said screen includes a plurality of raised regions formed as substantially vertical deflector strips spaced from one another around the inside surface of the screen.

14. The dryer as set forth in claim 13, wherein said deflector strips are arranged in a staggered array from adjacent a bottom edge of the screen to adjacent a top edge thereof.

15. The dryer as set forth in claim 12, wherein said screen includes perforated and non-perforated areas, said deflector strip being formed in a non-perforated area.

16. The dryer as set forth in claim 12, wherein said screen includes perforated and non-perforated areas, said deflector strip being formed in a perforated area.

17. The dryer as set forth in claim 13, wherein each deflector strip has a smoothly continuous ramped edge with adjacent non-raised portions of said screen inner surface.

18. The dryer as set forth in claim 13, wherein said raised deflector strips have a width of from about 0.25 inches to about 0.80 inches and protrude inwardly, relative to non-raised portions of said inner surface, about 0.10 inches to about 0.25 inches.

19. The dryer as set forth in claim 13, wherein said raised deflector strips have a width of about 0.62 inches and protrude inwardly, relative to non-raised portions of said inner surface, about 0.14 inches.

20. The dryer as set forth in claim 11, wherein said screen includes a plurality of interconnected, vertically aligned screen sections.

21. The dryer as set forth in claim 20, wherein each of said screen sections has a raised region forming a deflector strip such that said deflector strips extend in a substantially continuous arrangement from a top of the dryer to a bottom thereof.

22. The combination as set forth in claim 1, wherein said screen includes perforated and non-perforated areas, said raised regions being formed in a perforated area.

* * * * *